US011672301B2

(12) United States Patent
Goode

(10) Patent No.: US 11,672,301 B2
(45) Date of Patent: Jun. 13, 2023

(54) INTERCHANGEABLE STRAP SYSTEM AND DEVICE FOR OPEN-TOED FOOTWEAR

(71) Applicant: FLP/FLP LLC, Bountiful, UT (US)

(72) Inventor: Ryan Goode, Bountiful, UT (US)

(73) Assignee: FLP/FLP LLC, Bountiful, UT (US)

( * ) Notice: Subject to any disclaimer, the term of this patent is extended or adjusted under 35 U.S.C. 154(b) by 0 days.

(21) Appl. No.: 17/341,985

(22) Filed: Jun. 8, 2021

(65) Prior Publication Data

US 2021/0378351 A1 Dec. 9, 2021

Related U.S. Application Data

(60) Provisional application No. 63/036,001, filed on Jun. 8, 2020.

(51) Int. Cl.
*A43B 3/12* (2006.01)
*A43B 3/24* (2006.01)

(52) U.S. Cl.
CPC ..... *A43B 3/122* (2013.01); *A43B 3/128* (2013.01); *A43B 3/24* (2013.01)

(58) Field of Classification Search
CPC .. A43B 3/12; A43B 3/122; A43B 3/24; A43B 3/244
USPC ..... 36/11.5, 100, 101
See application file for complete search history.

(56) References Cited

U.S. PATENT DOCUMENTS 4,172,330 A * 10/1979 Kao ..... A43B 3/103 36/11.5
8,132,342 B1 * 3/2012 Moon ..... A43B 3/103 36/12
2006/0080813 A1 * 4/2006 Pearce ..... A43B 3/244 24/662
2006/0112596 A1 * 6/2006 Chan ..... A43B 3/122 36/11.5
2006/0112597 A1 * 6/2006 Stern ..... A43B 3/244 36/11.5
2007/0245597 A1 * 10/2007 Krutilek ..... A43B 3/103 36/101
2008/0060227 A1 * 3/2008 Enderson ..... A43B 3/103 36/23
2008/0110054 A1 * 5/2008 Lewis ..... A43B 3/103 36/15
2010/0132223 A1 * 6/2010 Lewis ..... A43B 3/103 36/101
2010/0212184 A1 * 8/2010 Rudd, Jr. ..... A43B 3/24 36/11.5
2011/0214311 A1 * 9/2011 Stonisch ..... A43B 13/12 36/15
2012/0311889 A1 * 12/2012 George ..... A43B 3/103 36/101
2014/0196307 A1 * 7/2014 Fremming ..... A43B 3/244 36/15
2015/0237950 A1 * 8/2015 Caldwell ..... A43B 3/126 36/100

(Continued)

*Primary Examiner* — Marie D Bays
(74) *Attorney, Agent, or Firm* — Travis Banta; Loyal IP Law, PLLC

(57) ABSTRACT

Disclosed herein is an interchangeable strap on an opened toed footwear that includes a sole and a strap. Connected to one or more of the ends of the strap is an insert. The sole of the footwear includes housing units that are connectable to the strap inserts found on one or more strap end. The connection between the insert and the housing unit is both connectable and detachable.

17 Claims, 5 Drawing Sheets

(56) References Cited

U.S. PATENT DOCUMENTS

| | | | | |
|---|---|---|---|---|
| 2019/0261726 | A1* | 8/2019 | L'Hermet | A43B 3/10 |
| 2019/0261727 | A1* | 8/2019 | L'Hermet | A43B 3/10 |
| 2020/0046063 | A1* | 2/2020 | Salmon | A43D 1/02 |

* cited by examiner

INTERCHANGEABLE STRAP SYSTEM AND DEVICE FOR OPEN-TOED FOOTWEAR

BACKGROUND

1. Technical Field

This disclosure relates to open-toed footwear. More particularly, this disclosure provides an open-toed footwear with interchangeable straps to allow either the replacement of a worn or damaged strap or to allow the exchange of a strap to another strap.

2. Description of the Related Art

Conventional thong sandals or more colloquially named, flip flops, are ubiquitous contemporarily and have been used for millennia. Thong sandals are thought to have originated in Egypt around 4000 B.C. Both the ancient Romans and the Greek were known to have used thong sandals. The ancient Greeks wore thong sandals by putting a strap between the second and third toe while the ancient Romans placed the strap between the first and second toe. The simplicity of a thong sandal construction has not changed much since ancient times except for, perhaps, changes based on the materials used in thong sandal production. Early Egyptian thong sandals were made of *papyrus* and reed, African thong sandals were made of leather, Indian thong sandals were made from wood and Chinese thong sandals were made using rice straw. Thong sandals throughout the ages have included, at times, a strap around the heel of the user. However, the most simple form of a thong sandal implements a strap that is positioned across a front of the user's foot.

This simple form of thong sandals includes a sole and a strap that connects in three locations and usually connects through the sole with a stopper that is retained in position by the bottom of the sole. The first connection point is generally located in the front middle part of the sandal and positioned such the connection point is comfortably situated between the user's toes to keep the user's foot from sliding forward off of the sole. The second and third connection points are located further back on the sole on the inside portion and the outside portion of the sole respectively. The second and third connection points cradle the inside and outside of the user's foot to keep the foot centered on the sole. This design is simple, effective, and inexpensive to produce. For these and other reasons, few design changes have been made through the years. However, while sandals are simple, they frequently experience breakage. Since the strap only connects to the sole in three places, these connections are subject to significant pressure and often break rendering the thong sandal ineffective and unwearable. Breaking the straps on thong sandals is so well known as one of the problems of flip flops, pop culture references to broken sandals are frequently encountered.

Another problem of thong sandals has arisen from current fashion trends. Thong sandals are used in various occasions, both formal and informal, in situations that may socially obligate the wearer to adorn thong sandals with more formal straps. The sandal soles are generally covered by the wearer's foot and may need not be exchanged. Approaches have been made to make straps match the occasion without having to purchase event specific sandals. One solution has been to create a hook and loop system to allow the outside portion of the strap to be replaceable by connection and disconnection of the loop from the hook. In this manner, the permanent strap is comprised of loops on its outside surface, while the replaceable strap covers have hooks covering its underside. Consequently, the replaceable strap covers hooks can be secured to the top of the permanent strap loops adjusting the look to the sandal to match the occasion. Another solution is to have three loops that connect to the sole of the sandal and extend upwards from the sandal allowing replaceable straps to be interchanged by connecting the replaceable straps to each of the loops that are connected to the sole.

Unfortunately, these conventional solutions suffer from various problems. For example, with the hook and loop solution does not solve the problem of a broken strap between the sole and the strap, which is generally where a strap is broken. Also, if is the strap is blemished by damage, dirt, stain, or discoloration on the permanent portion of the strap, merely covering the replacement straps may still leave the blemish exposed. Furthermore, replacement strap covers often appear temporary and do not appear original. Using the loop connector system has similar problems. For example, if a breakage occurs on the loop replacement straps cannot be connected. Additionally, the loops coming out of the sole are in close proximity to the foot and the additional bulk between the toes may cause the user discomfort.

It is one object of this disclosure, therefore, to provide a replaceable strap for a sandal. It is another object of this disclosure to provide a replaceable strap that allows the user to replace a damaged strap while also continuing the use of the same sole with a new clean functional strap.

SUMMARY

Disclosed herein is a sandal sole with an interchangeable strap. The interchangeable strap may include an insert attached to one or more of the ends of the interchangeable strap. The sandal sole may include one or more housing units located within the surface of the sandal sole. One or more of the inserts attached to the one or more ends of the interchangeable straps may connect to one or more of the housing units located within the surface of the sandal sole. The interchangeable strap is secured to the sandal sole through the connection between one or more insert and one or more housing unit.

BRIEF DESCRIPTION OF THE DRAWINGS

The accompanying drawings illustrate one or more embodiments of an interchangeable strap system and device.

DETAILED DESCRIPTION

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
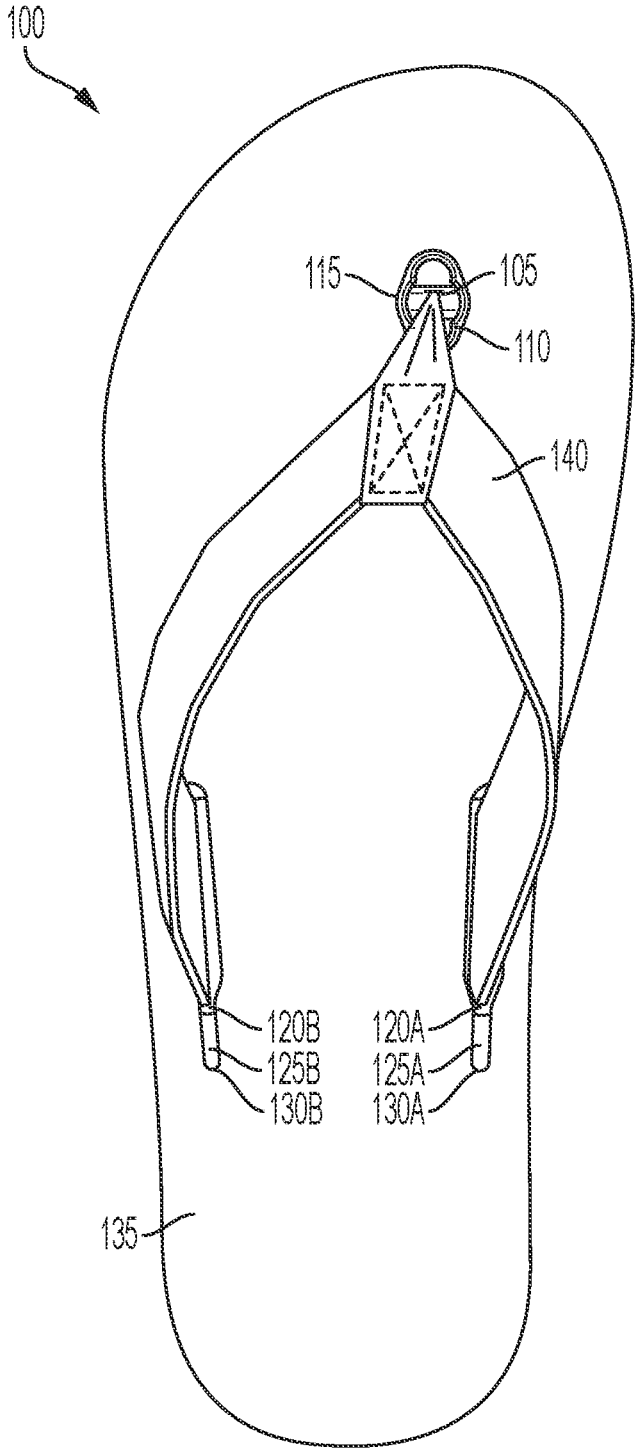
FIG. 1 illustrates a top view of a thong sandal comprised of an interchangeable strap system and device.

FIG. 1 illustrates a top view of thong sandal 100 comprised of an interchangeable strap system and device. Sandal 100 includes foot strap 140 and sole 135. Foot strap 140 may be attached to sole 135 in three locations one located on the distal location of sole 135 and two on the side of sole 135 situated proximate to the front location. Sole 135 may include multiple layers that could include a top layer, a first middle layer, an arch support layer, a second middle layer, and a bottom layer. One or more of these layers may be composed of leather, memory foam, EVA foam, and/or vulcanized rubber. Other materials may be used such as polyurethane, gel foam, latex rubber foam, convoluted foam, styrene butadiene rubber, nitrile rubber, butyl rubber, Neoprene®, ethylene propylene diene monomer rubber, polyurethane, thermoplastic polyurethane and fabric used in alone or in combination with one or more of the previously mentioned materials. Also, each layer may be sized differently and may not cover or match the layer above or below.

Sole 135 may include front housing well 115, side wells 130A and 130B. Front housing well 115 and side wells 130A, and 130B may be comprised of apertures in the different layers of the sole. Front housing well 115 and side wells 130A and 1308 may include a combination of apertures in different layers. For example, side well 130A may include apertures in sole 135 that include the top layer first middle layer and a well in the arch support layer that does not extend through the arch layer. At the same time, side well 1308 may include apertures in sole 135 that include the top layer, the first middle layer, and the second middle layer. Front housing well 115 and side wells 130A, and 130B may or may not extend through any combination of layers.

Front housing well 115 may be sized to accommodate front housing 110 such that the front housing 110 sits within the well in a manner that allows the housing to either be substantially even with or below a height of the top layer of sole 135. Substantially even means no more than 10% of the height of the housing sits above the top layer of the sole 135. Front housing 110 may be secured in front housing well 115 by various manners i.e. adhesive, rivet, snap, and or a lip sandwiched between sole layers. Front housing 110 may be comprised of two parts a base and a cap (described below). The base and cap may include fasteners that allow the cap and the base to join. The cap and base may join by snap fit, adhesive, bolts and other ways known in the art. The cap may include an opening that shaped to allow the mating of front insert 105.

Front insert 105 may include a crown and a base that are sized differently i.e. the base may be longer than the crown. The front insert 105, including both base and crown, is sized to be inserted though the opening in only one direction and cutouts in the cap of front housing may allow fronts strap insert to twist into a locking position. The base of front housing 110 may include magnets attached to the inside bottom of the base that connect with corresponding magnets inserted into the bottom of the base of front insert 105 that come in contact when front insert 105 is twisted into the locked position. Thong sandal 100 includes a twisting lock connector between front insert 105 and front housing 110, but other connector types may be used in place of or with the current depicted connector. Examples of these alternative or supplementary connectors may include a snap, a hook and loop, and or corresponding screw type threading between front insert 105 and front housing 110.

Front insert 105 also includes a vent that allows the front insert 105 to be connected to the strap 140. When front insert 105 is inserted into front housing 110 the insert and the housing may be even with or below the top layer of the of sole 135. In this manner, strap 140 may extend upward out of sole 135 permitting the user's foot to contact strap 140 instead of the user's foot making contact with front insert 105 or front housing 110.

Side wells 130A and 130B may be sized to accommodate side housing 125A and 125B respectively. Side housing 125A and 125B may include two parts, a cap and a base that connect together, as will be described with respect to other figures, below. The cap may include an opening sized to accommodate side inserts 120A and 120B correspondingly. The opening may include a large portion and a thin portion to allow side insert 120A and 120B to slide in to side wells 130A and 130B and remain secure. Side housing 125A and 125B further include a lip that aids in securing and releasing side insert 120A and 120B. Side inserts 120A and 1208 may include a slot extending along the length of the side inserts 120A and 1208. Above the slot along the top edge of the side inserts 120A and 120B may be a backbone to add strength and support and to act as a locking mechanism when place into side housing 125A and 125B. The slot is sized to accommodate strap 140. Strap 140 may include three or more different ends. One end may attach to the front insert 105 and the other two ends attaches to the side inserts 120A and 120B. Strap 140 may be attached to side inserts 120A and 120B in various manners and is depicted exemplarily as being looped through the slot and sewn back to the strap 140. At the distal end (e.g., closest to a toe end of the sandal) of side inserts 120A and 1208 is the nose portion that includes a notch on the bottom and a gap that inserts into the distal end of side housings 125A and 125B. The notch slides over a protuberance found in the base of a side housings 125A and 125B. When in the locked position side inserts 120A and 1208 is located near or contacts the lip on side housings 125A and 125B.

Figure 2:
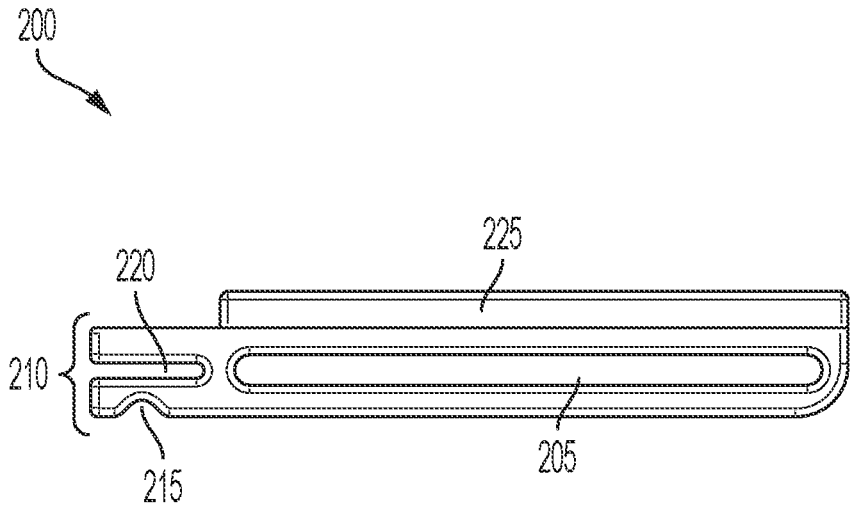
FIG. 2 illustrates a side view of a side insert of an interchangeable strap system and device.

FIG. 2 illustrates a side view of a side insert 200 of an interchangeable strap system and device. Side insert 200 includes slot 205 that extends along the length of side insert 200. Located above the slot 205 is spine 225 which also runs along the length of side 200. A width of spine 225 is thinner than the width of the rest of side insert 200. At the distal end of side insert 200 is nose 210 (which includes a top and bottom prong) that is situated distally to the end slot 205. Nose 210 includes a notch 215 on the bottom end of the bottom prong and a gap 220 between the bottom and the top prongs. Side insert 200 is sized to fit inside a side housing not shown. One or more strap can be attached to side insert 200.

Figure 3:
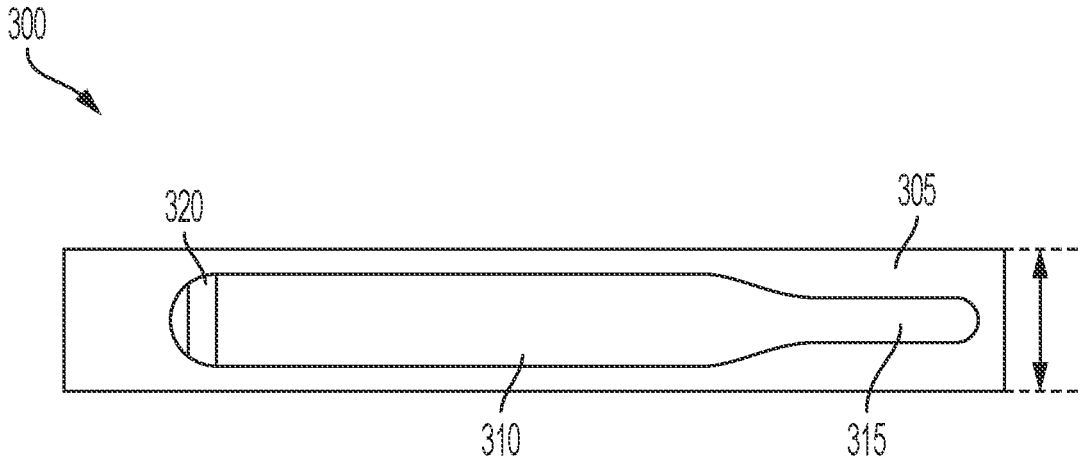
FIG. 3 illustrates a top view of a side housing of an interchangeable strap system and device.

FIG. 3 illustrates a top view of a side housing 300 of an interchangeable strap system and device. Side housing 300 may include cap 305 and a base (not shown) that connect together. Cap 305 includes an opening with a wide portion 310 towards the distal end and a narrow portion 315 towards the proximal end. At the distal end of the opening is lip 320. Also, not shown is the base an on the bottom of the base towards the distal end is a protuberance that coincides with a notch place on a side insert, such as notch 215 shown in side insert 200 of FIG. 2. The shape of side housing 300 corresponds to the shape of one or more of the side wells.

Figure 4A:
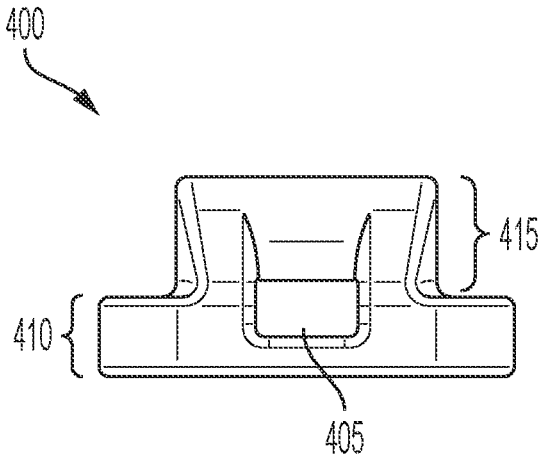
FIG. 4A illustrates a side view of a front insert of an interchangeable strap system and device.

FIG. 4A illustrates a side view of a front insert 400 of an interchangeable strap system and device. Front insert 400 includes vent 405 that allows one or more straps to connect at this point. Alternatively, the strap may connect to front insert 400 that may include as part of front insert 400 a snap, bolt, adhesive, rivet button or other connective devices know to the art. Front insert 400 also includes a crown 415 and a base 410. Crown 410 is smaller in not as long as base 410.

Figure 4B:
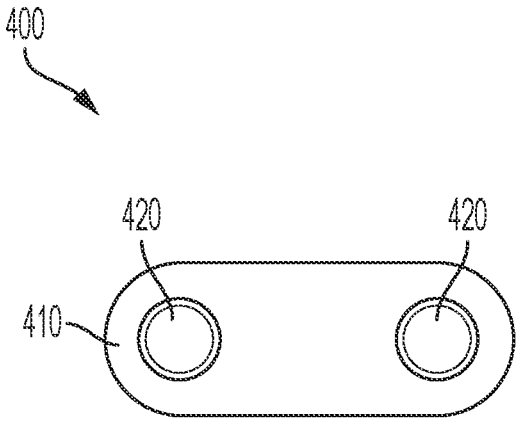
FIG. 4B illustrates a bottom view of a front insert of an interchangeable strap system and device.

FIG. 4B illustrates a bottom view of a front insert 400 of an interchangeable strap system and device. Base 410 includes magnets 420 that are attached to the bottom side of base 410. Magnets 420 may correspond with magnets (not shown) found in a front housing. Other connecting devices may be attached to a front insert 400 to facilitate the connection between front insert 400 and a front housing.

Figure 5:
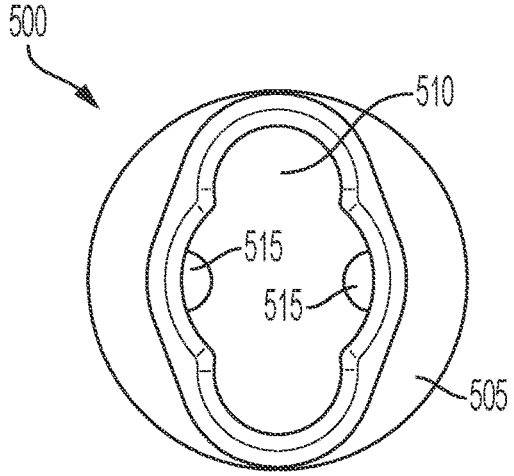
FIG. 5 illustrates a top view of a front housing of an interchangeable strap system and device.

FIG. 5 illustrates a top view of a front housing 500 of an interchangeable strap system and device. Front housing 500 includes cap 505 and a base (not shown). Cap 505 includes opening 510 that may accommodate a front insert. Opening 510 includes a length that can accommodate the length of the base. Also, a middle of the opening includes a portion of the opening that is sized to accommodate the length of the crown when is turned perpendicularly after a front insert, such as front insert 400, shown in FIG. 4, enters the opening. Connected the base are magnets 515 that connect to corresponding magnets found on the bottom side of a front insert 400 and connect when the insert is twisted perpendicularly after being inserted into front housing.

Figure 6:
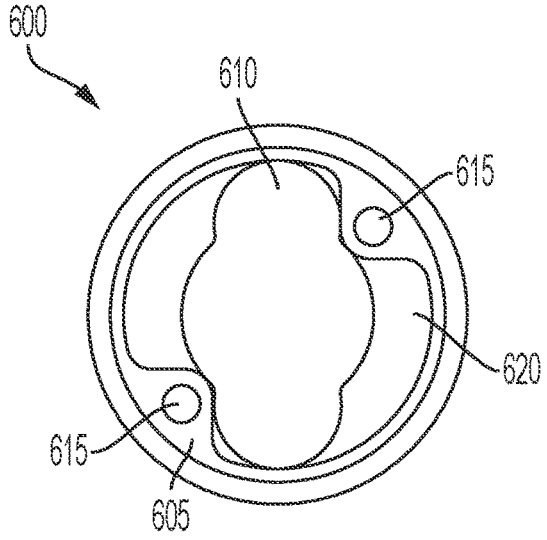
FIG. 6 illustrates a bottom view of a front housing cap of an interchangeable strap system and device.

FIG. 6 illustrates a bottom view of a front housing cap 600 of an interchangeable strap system and device. Front housing cap 600 includes an opening 610 which has a length that can accommodate a length of the base of front insert 400. Also, the middle of the opening includes a portion of the opening that is sized to accommodate the length of the crown when the crown is turned perpendicularly after a front insert enters the opening. Upon entrance cutout portion 610 combined with the opening 610 allows a front insert to turn perpendicularly. Front housing cap may further include an uncut portion 605 that creates a stopping point to help a front insert to sit perpendicularly to opening 610. Also, uncut portions may include fasteners 615 that facilitate the connection between front housing cap 600 and front housing base.

Figure 7:
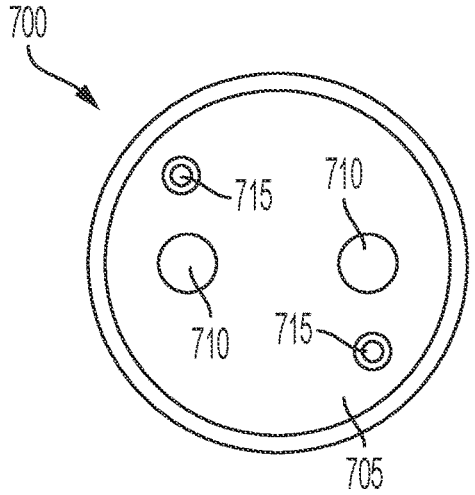
FIG. 7 illustrates a top view of a front housing base of an interchangeable strap system and device.

FIG. 7 illustrates a top view of a front housing base 700 of an interchangeable strap system and device. Front housing base 700 includes seat 705 and within seat 705 are magnets 710 and fasteners 715. Magnets 710 correspond to a front insert when it is the locked position. Fasteners 715 correspond to front housing cap depicted in FIG. 6 to allow the connection between front housing base 700 and front housing cap as depicted in FIG. 6.

Figure 8:
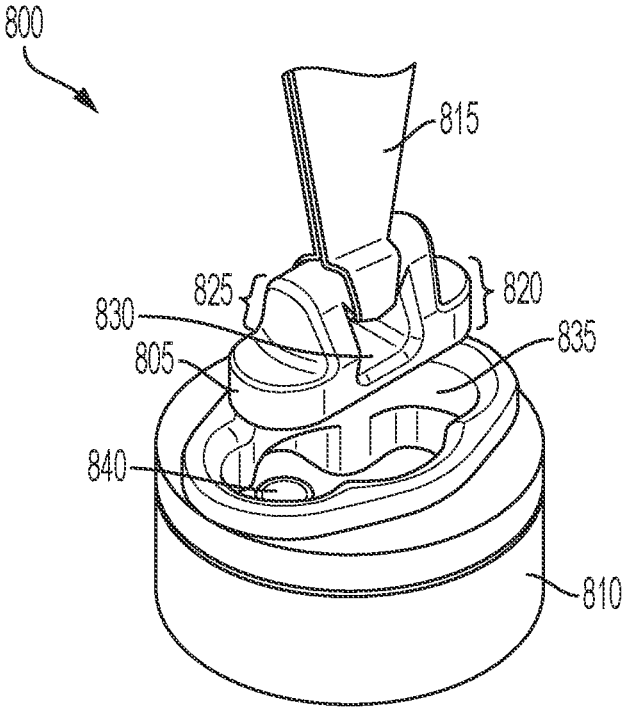
FIG. 8 illustrates a perspective view of a front insert and a front housing of an interchangeable strap system and device.

FIG. 8 illustrates a perspective view of front insert 805 and front housing 810 of an interchangeable strap system and device 800. Front insert 805 includes vent 830 that provides a connection point for strap 815. More than one strap can connect at vent 830. Alternatively, strap 815 may connect to front insert 805 in various ways i.e. snap, bolt, adhesive, rivet button or other connective devices know to the art. Front insert 805 also includes a crown 825 and a base 820. Crown 825 is smaller in not as long as base 820. Base 820 of front housing insert 805 may include one or more magnets (not shown) that are attached to the bottom side of base 820. Magnets may correspond with one or more magnets 840 found in a front housing 810. Other connecting devices may be attached to a front insert 805 to facilitate the connection between front insert 805 and a front housing 810.

Interchangeable strap system 800 also includes front housing 810 which may be comprised of a cap and a base not shown. Cap includes opening 840 that may accommodate front insert 805. Opening 835 includes a length that can accommodate the length of the base. Also, disposed in a middle of the opening there is a portion of the opening that is sized to accommodate the length of the crown when is turned perpendicularly after a front insert 805 enters the opening. Connected the base are magnets 840 that connect to corresponding magnets found on a front insert 805 and connect when the insert is twisted perpendicularly after being inserted into front housing 810.

Figure 9:
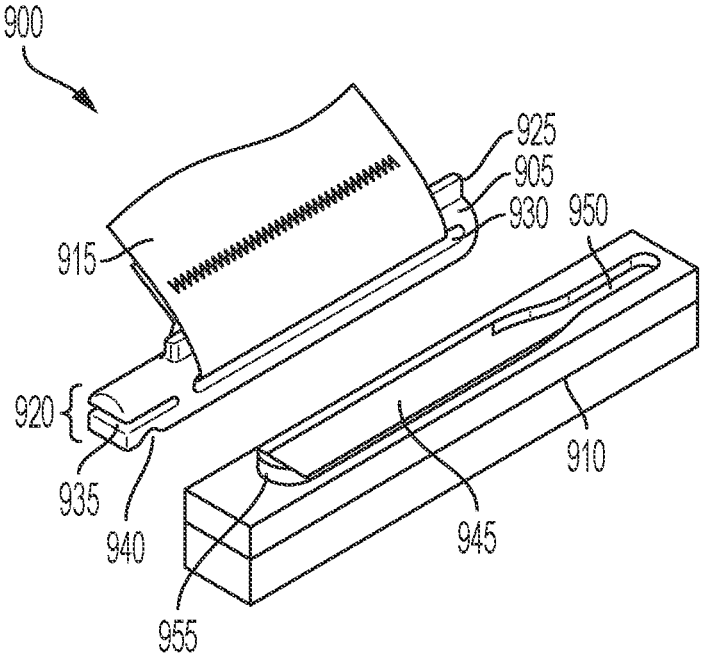
FIG. 9 illustrates a perspective view of a side insert and a side housing of an interchangeable strap system and device.

FIG. 9 illustrates a perspective view of a side insert 905 and a side housing 910 of an interchangeable strap system and device 900. Interchangeable strap system 900 is comprised of side insert 905 that may include slot 930 that extends along the length of side insert 905. Located above the slot 930 is spine 925 it too runs along the length of side 905. A width of spine 925 width is thinner than the width of the rest of side insert 905. At the distal end of side insert 905 is nose 920 that is situated distally to the end slot 930. Nose 920 includes a notch 940 on the bottom end of the bottom prong and a gap 935 between the bottom and the top prongs. Side insert 905 is sized to fit inside side housing 910.

Side housing 910 may include a cap and a base that connect together. Cap includes an opening with a wide portion 945 towards the distal end and a narrow portion 950 towards the proximal end. At the distal end of the opening is lip 955. Also, not shown the base an on the bottom of the base towards the distal end is a protuberance that coincides with notch 940 places on a side insert 905. The shape of the interior of side housing 910 corresponds to the shape of side wells 905.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A footwear device, comprising:

a sole comprising:

a front housing disposed within the sole comprising:

one or more magnets disposed in the front housing, a side housing disposed within the sole;

a strap comprising:

a front insert attached to a first end of the strap comprising:

a crown on a top portion of the front insert, a base on a bottom portion of the front insert, and one or more magnets disposed in the front insert, wherein the front insert is connectable to the front housing by an opening disposed in the front housing, wherein the opening is sized to accommodate a length of the base and a portion of the opening is wider to accommodate a length of the crown in a locking position;

a side insert attached to a second end of the strap, and wherein the side insert is connectable to the side housing.

2. The footwear device of claim 1, wherein the front insert is insertable into the front housing through the opening at a first position and the inserted first insert is twistable to the locking position within the front housing.

3. The footwear device of claim 2, wherein one of the one or more magnets in the front housing attaches the one or more magnets in the front insert when twisted to the locking position.

4. The footwear device of claim 1, wherein the wider portion is located between two narrow portions of the opening in the front housing.

5. The footwear device of claim 1, wherein the strap connects to the front insert through a vent disposed in the front insert.

6. The footwear device of claim 1, wherein the strap connects to the side insert through a slot disposed in the side insert.

7. The footwear device of claim 1, wherein the side insert further includes a nose on an end of the side insert.

8. The footwear device of claim 7, wherein the nose further includes one or more prongs.

9. The footwear device of claim 8, wherein the nose further includes a notch located on one of the one or more prongs.

10. The footwear device of claim 9, wherein the side insert further includes a spine located on an upper portion of the side insert.

11. The footwear device of claim 10, wherein the side housing includes an opening at an upper end of the side housing.

12. The footwear device of claim 11, wherein the opening of the side housing includes a wide portion and a narrow portion.

13. The footwear device of claim 12, wherein the narrow portion of the opening in the side housing is sized to accommodate the spine of the side insert.

14. The footwear device of claim 13, wherein the narrow portion of the opening is located at a first end of the opening.

15. The footwear device of claim 14, wherein the wide portion of the opening is located at a second end of the opening.

16. The footwear device of claim 15, wherein the wide portion of the opening in the side housing is sized to accommodate a widest portion of the side insert including an added width of the attached strap.

17. The footwear device of claim 1, wherein a second side insert is attached to the strap at a third end and is connectable to a second side housing disposed within the sole.

* * * * *